United States Patent [19]

Pipkin

[11] 4,327,130

[45] Apr. 27, 1982

[54] METHOD AND APPARATUS FOR FORMING A COATING ON BOTH SIDES OF A SUBSTRATE

[75] Inventor: David J. Pipkin, Longmont, Colo.

[73] Assignee: International Business Machines Corporation, Armonk, N.Y.

[21] Appl. No.: 207,590

[22] Filed: Nov. 17, 1980

Related U.S. Application Data

[60] Division of Ser. No. 53,143, Jun. 27, 1979, abandoned, said Ser. No. 53,143, is a continuation-in-part of Ser. No. 882,281, Feb. 23, 1978, abandoned.

[51] Int. Cl.[3] ..... B05D 3/12

[52] U.S. Cl. ..... 427/209; 118/106; 118/126; 118/405; 118/411; 118/412; 118/413; 427/355; 427/369; 427/371

[58] Field of Search ..... 118/405, 407, 410, 411, 118/419, 420, 413, 415, 106, 126; 427/331, 355, 356, 358, 365, 370, 371, 209; 425/377, 380, 224, 113

[56] References Cited

U.S. PATENT DOCUMENTS

| | | | |
|---|---|---|---|
| 62,044 | 2/1867 | Lowe | 118/106 |
| 1,632,760 | 6/1927 | Jones | 118/419 X |
| 1,972,457 | 9/1934 | O'Brien et al. | 118/413 |
| 2,659,340 | 11/1953 | Zinn, Jr. | 118/202 |
| 3,081,191 | 3/1963 | Smith et al. | 118/126 |
| 3,352,706 | 11/1967 | Alkofer | 118/123 |
| 3,352,706 | 11/1967 | Alkofer | 117/64 |
| 3,544,669 | 12/1970 | Schock | 425/113 X |
| 3,575,134 | 4/1971 | Quint | 118/122 |
| 3,688,738 | 9/1972 | Eichler et al. | 118/62 |
| 3,729,376 | 4/1973 | Stevens | 162/306 |
| 3,839,071 | 10/1974 | Borelli et al. | 118/637 X |
| 3,889,018 | 6/1975 | Quint | 427/209 |
| 3,908,590 | 9/1975 | Quint | 118/122 |
| 3,956,056 | 5/1976 | Boguslawski et al. | 425/113 X |
| 4,012,188 | 3/1977 | Lemelson | 425/224 X |
| 4,063,531 | 12/1977 | Zitzow | 118/122 |
| 4,076,864 | 2/1978 | Wallsten | 427/209 |
| 4,076,865 | 2/1978 | Wallsten | 427/209 |

FOREIGN PATENT DOCUMENTS 2633111 2/1978 Fed. Rep. of Germany .

*Primary Examiner*—Ralph S. Kendall
*Attorney, Agent, or Firm*—Francis A. Sirr

[57] ABSTRACT

Method and apparatus for coating both sides of a moving web and for independently controlling the coatings' width, thickness and uniformity of thickness along the length of the web. A moving web is supported on a backing surface. Two stationary and pliant smoothing films are positioned one adjacent each surface of the web, including the web surface which is supported by the backing surface. A coating liquid is metered to each side of the web at the confluence of the web and the two smoothing films, the respective metering rates being selected to produce a desired respective coating width. A pliant pressure generating means, in the form of a membrane holds a length of one smoothing film against the moving web with a static force whose magnitude is selected in accordance with a desired coating thickness. The relative position of the backing surface and the pressure generating means determines the length of coincidence of the moving web, coating liquid, stationary smoothing films and pressure generating means. This length is selected, by virtue of selecting a relative position, to thereby apply a high hydrodynamic force to the coating liquid for at least a critical time interval, such that slight variation of this time interval no longer produces appreciable variation in coating thickness along the length of the web, and uniformity of coating thickness is thus achieved. In a second embodiment, a second pliant pressure generating means functions as the backing surface.

20 Claims, 6 Drawing Figures

METHOD AND APPARATUS FOR FORMING A COATING ON BOTH SIDES OF A SUBSTRATE

DESCRIPTION

Related Applications

This application is a division of copending application Ser. No. 053,143, filed June 27, 1979, and entitled "Method and Apparatus for Forming a Coating on a Substrate", now abandoned. Said application Ser. No. 053,143 is a continuation-in-part of application Ser. No. 882,281, filed Feb. 23, 1978, and entitled "Method and Apparatus for Forming a Coating on a Substrate", now abandoned.

BACKGROUND OF THE INVENTION

The present invention relates generally to coating a substrate or moving web with a coating fluid, and more particularly to a method and apparatus for coating a moving web by conducting the web to a metered source of coating fluid and urging a pliable smoothing film against the web by means of controllable pressure generating means, such as an inflatable membrane, the pressure generating means being adjacent to and downstream of the position at which the coating fluid is metered onto the web and/or the smoothing film.

There exists a great number of means and apparatus for coating liquids onto moving substrates. For instance, doctor knives may be employed to smooth and control the coating onto the substrate. Rollers may be employed to apply coatings either singularly, i.e., instances in which the roller passes through a reservoir of coating liquid and conducts the liquid directly to the substrate, or in combination such as in instances in which the substrate is passed between the nip of adjacent rollers to control coating. Coatings may be extruded in quite thin layers directly onto the substrate. The substrate may be dipped into a reservoir of coating liquid, either free-running as a web, or while being conducted around a roller, and air brushes or resilient wipers may be employed to remove the excess coating material from the substrate.

An early example of one wiping means is found in U.S. Pat. No. 62,044, issued Feb. 12, 1867. In this patent, a static cloth is stretched partially around a roller to generate a wiping action for bronze powder.

More recent U.S. Pat. No. 3,688,738, issued Sept. 5, 1972, discloses a coating means in which a substrate in the form of a web is conducted around a roller which is immersed in a coating fluid. A wiping film, which does not extend beyond the roller, is employed to remove excess coating fluid from the substrate and return it to the reservoir. In certain embodiments, an additional static film is employed to bear against the wiping membrane. However, it is generally not desirable to coat to the edge of the substrate. Excess coating material is flung from the edge as the web advances. Also, it is often useful to provide an uncoated margin. Thus, the simple apparatus of U.S. Pat. No. 3,688,738 is rather restricted as to the nature of the coatings produced and speed of operation.

U.S. Pat. No. 3,352,706 is another example of a coating method in which excess coating material is applied to a web and a squeegee, which may be a flexible piece of plastic or rubber backed by resilient members such as stiffer sheets of plastic or rubber, is employed to remove the excess coating liquid from the web. Again, no provision is made for other than complete coating of the web with excess coating liquid. The patent is rather specific as to the need for a run-off path for the material.

Devices and methods for coating both sides of a web in essence utilize the above-mentioned concepts. For instance, according to U.S. Pat. No. 4,076,864, a web is guided through a bath of coating liquid with excess coating liquid removed by a doctor blade adjacent a backup roller. U.S. Pat. Nos. 3,575,134 and 3,908,590 are further examples of devices for coating both sides of a web, such as paper.

SUMMARY OF THE INVENTION

The present invention, which provides a heretofore unavailable combination of desirable features in the coating art, comprises an apparatus and method for coating in which a substrate in the form of a web is conducted through a controlled-length, high-hydrodynamic-pressure coating zone in which a controlled amount of a coating liquid is provided to both sides of the web.

The present invention finds special utility when coating the aforesaid web with a non-newtonian fluid, i.e., a fluid whose viscosity changes with rate of flow. Such fluids have also been described as thixotropic and pseudoplastic fluids. The method and apparatus of the present invention meters the fluid to the confluence of a moving web and a stationary smoothing film. As a result, the fluid is subjected to high shear force and its viscosity is reduced to thereby enable the coating of a thin fluid film onto the web. The present invention operates to subject the fluid to a high hydrodynamic pressure for a time interval which is determined by the speed of the web and the length of the coating zone, this length being measured in the direction of web travel.

A substantially static force generating means, such as a fluid-containing membrane, bears against a portion of the web which is supported by a backing means such as a stationary guide plate or a second fluid-containing membrane. A stationary smoothing film is interposed between the force generating means and the moving web. Thus, a high-hydrodynamic-pressure coating zone is provided to the coating fluid at the zone of coincidence of the backing means, the moving web, the stationary smoothing film and the force generating means.

A metering zone is provided upstream of this coating zone, adjacent the confluence of the web and the smoothing film, such that a coating liquid can be metered to the coating zone. The rate at which liquid is metered determines the width of the web which is coated, width being measured transverse to the direction of web movement. Preferably, the rate of metering is controlled as a function of web speed.

As the liquid enters the coating zone, it is subjected to a high shear force, and a high hydrodynamic pressure is created in the liquid, by virtue of the influence of the moving web and the stationary smoothing film. The liquid's viscosity now decreases, and the web is coated to a thickness as determined by the magnitude of the static force provided to the coating zone by the force generating means, i.e., the higher the force, the thinner the coating. Thus, coating thickness is controlled by controlling the magnitude of this static force. Preferably, means such as an adjustable and regulated fluid pressure source is used with the membrane in order to control the magnitude of this static force.

The above-mentioned hydrodynamic pressure is maintained for the length of the coating zone. For any given web speed, the length of the coating zone directly translates into a residence time. In accordance with the present invention, this residence time is at least equal to a critical residence time. The term critical residence time is defined as that residence time which produces a coating thickness which does not appreciably change as residence time increases, all other factors such as web speed, for example, remaining constant. Preferably, a residence time operating point is chosen to be somewhat longer than the critical residence time, such that slight variation therefrom in either direction does not produce an appreciable change in coating thickness. As a result of such a residence time operating point, the web is coated to a uniform thickness along its traveling length. The residence time is changed by moving the membrane relative the web's backing support means.

Accordingly, an object of the present invention is to provide a new and improved method and apparatus for producing a quality coating on both sides of a moving web without relying upon precisely machined metal components.

Another object of the present invention is to provide a new and improved method and apparatus for coating in which the coating's width, thickness and uniformity may be readily controlled and varied.

Yet another object of the present invention is to provide a new and improved method and apparatus for coating in which the coating width may be conveniently controlled to be less than the entire width of the web.

Still another object of the present invention is to provide a new and improved method and apparatus for coating a moving web in which the coating liquid is utilized without recirculation of excess coating fluid to a coating fluid reservoir.

Yet still another object of the present invention is to provide a new and improved method and apparatus for coating a moving web in which the coating thickness and width may be readily controlled during on-line operation of the coating apparatus.

Still yet another object of the present invention is to provide a new and improved method and apparatus for coating at high speeds utilizing coating fluids under varying conditions including great variations in viscosities up to and including thixotropic materials, over substantial ranges of thickness including coatings thinner than those available with conventional gravure coating.

DESCRIPTION OF THE PREFERRED EMBODIMENT

Figure 1:
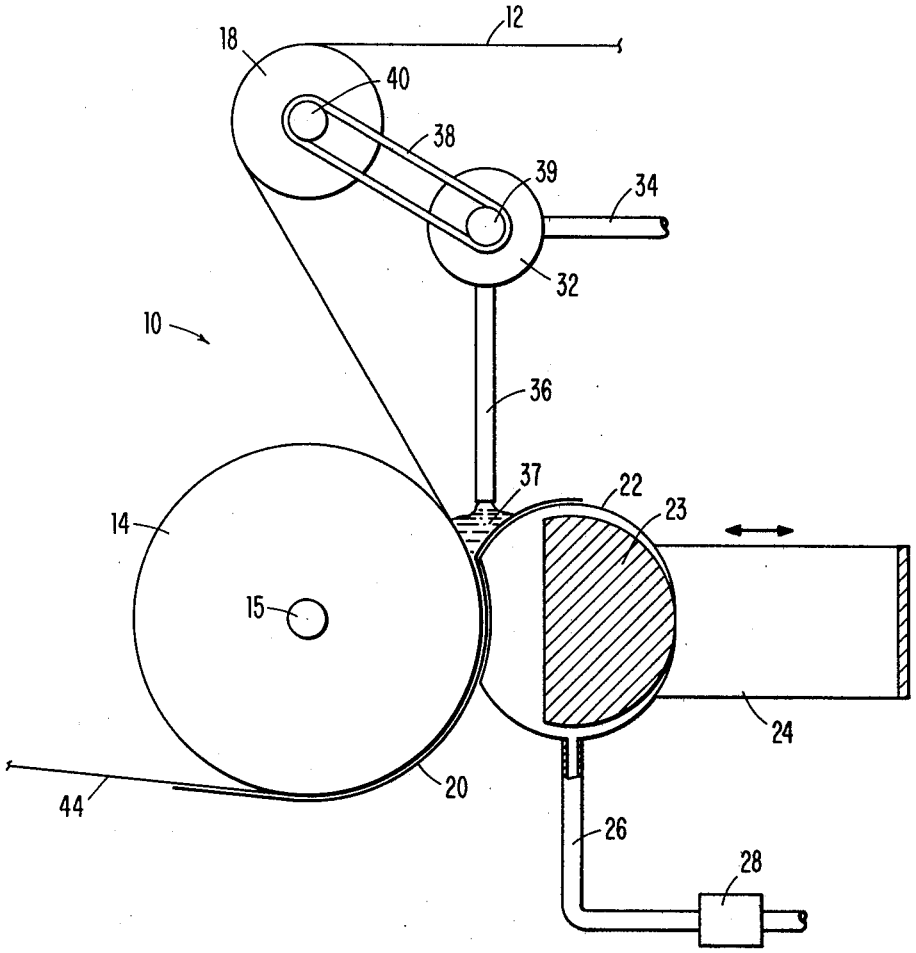
FIG. 1 is a simplified side view, partially in section, of a coating apparatus in accordance with said related applications.

Turning now to the drawings, a basic coating apparatus according to said related applications is illustrated at FIG. 1 and generally designated by reference numeral 10. An explanation of this coating apparatus will aid in understanding the present invention. As shown in FIG. 1 coating apparatus 10 engages web 12 at back-up roller 14, preferably mounted for rotation at axis 15 and driven at line speed. Roller 14 is an exemplary 6 inches in diameter and 14 inches in axial length. Line speed is the speed at which web 12 travels as it passes down through the coating zone or nip formed by the area of coincidence of 14 and 22. Guide roller 18 directs web 12 into contact with at least a substantial portion of the periphery of back-up roller 14.

Rollers 14 and 18 are conventional and in accord with normal coating practices for various substrates. For example, rollers 14 and 18 are of approximately equal axial length and are highly polished metal rollers. Web 12 is also, in most instances, a conventional substrate such as biaxially oriented polyethylene terephthalate (available under the trademark Mylar) acetates, polyolefins, or other such conventional polymeric films, paper, etc. Web 12 is an exemplary 0.0015 inch thick.

Figure 5:
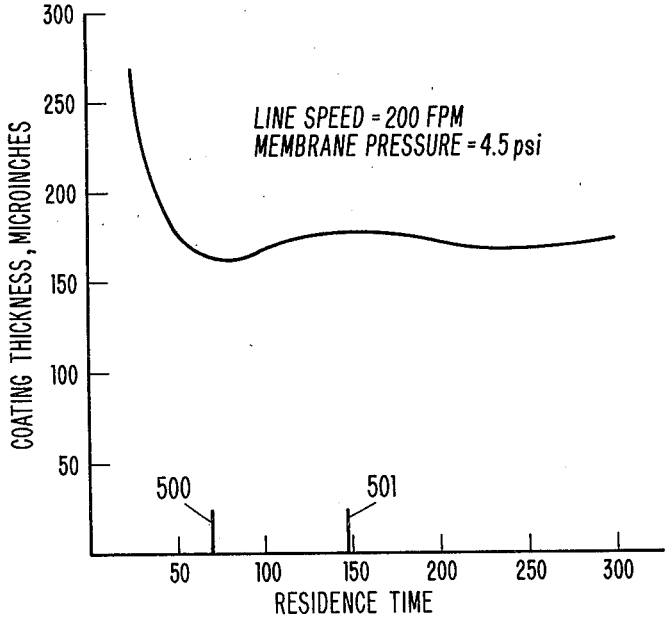
FIG. 5, which does not appear in said related applications, is a graph which depicts the manner in which the residence time operating point of the present invention is selected so that slight variation in residence time of the web, as it passes through the coating zone does not produce significant changes in coating thickness as measured along the length of the web.

Smoothing film 20 is positioned in an essentially stationary, static fashion adjacent web 12 and a portion thereof extends around the periphery of back-up roller 14. Preferably smoothing film 20 extends over a substantial portion of the circumferential portion of web 12 in contact with back-up roller 14, but not substantially beyond such contact. Pressure generating means such as pliable membrane 22 carried on mandrel 23 and secured to support 24 urges smoothing film 20 into contact with web 12 with a predetermined static force which is a function of the internal pressure of membrane 22. Membrane 22 is tubular in shape, an exemplary 1.5 inches in diameter, is somewhat longer than film 20 is wide. The tubular axis of membrane 22 extends parallel to the axis of roller 14 for all positions of the membrane. Support 24 preferably allows for movement towards and away from back-up roller 14 to vary the circumferential conformance length of membrane 22 to roller 14. For a fixed line speed, the greater the length of membrane conformance, the longer will be the coating zone, as measured in the direction of web travel, and the longer will be the residence time of the web in the coating zone. As depicted in FIG. 5, once at least a critical residence time has been achieved for any given coating situation, variation in residence time, as may be expected in a manufacturing situation, does not produce appreciable variation in coating thickness along the length of the web.

Figure 2:
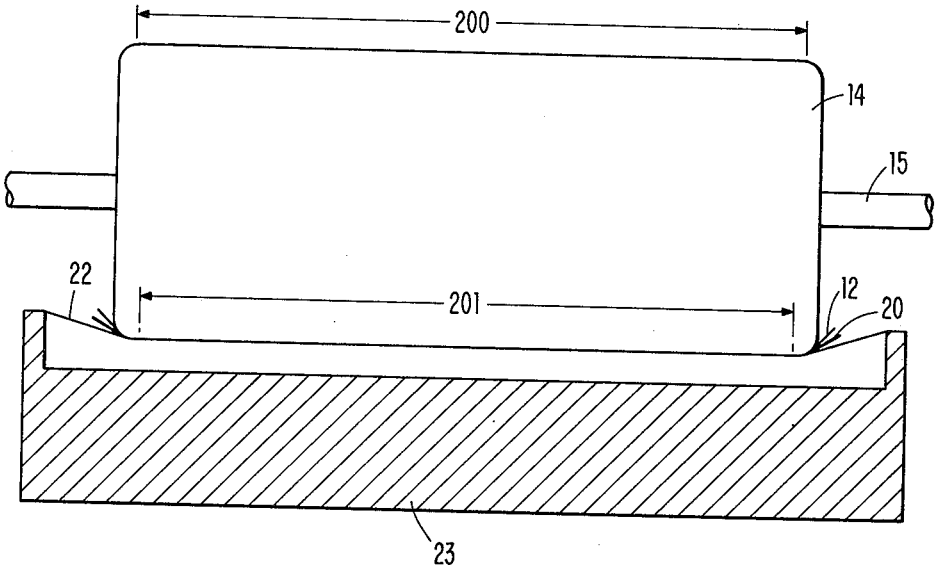
FIG. 2, which does not appear in said related applications, is a top view of the back-up support roller of FIG. 1. This figure shows the axial length of the roller as this length relates to the width of the membrane, smoothing film and moving web at about the center of the coating zone.

FIG. 2 is a top view of roller 14 and a section view of membrane 22, smoothing film 20 and web 12, for the purpose of showing the relative dimensions of these parts. As seen, the central portion 200 of roll 14 is a circular cylinder and is about 13.50 inches in axial length. The overall length of roller 14 is about 13.75 inches, the axial end surfaces being rounded, as shown. The portion 201 of the roll's circular cylinder is about 13.25 inches long and is the maximum area intended for use in coating web 12.

Web 12 and smoothing film 20 are about 14.0 inches wide. The end edges of roller 14 are rounded to minimize stress at the annular ends of the roller's circular cylinder portion 201. Membrane 22 is about 16 inches long and extends beyond both side edges of smoothing film 20 and web 12.

Line 26 communicates with the interior of membrane 22 and also with pressure regulating means 28 to supply a fluid, preferably air, to the interior of membrane 22. Thus, by regulating the internal pressure of membrane 22, the pressure generating means urges smoothing film 20 into contact with web 12 at a desired static force which may be readily regulated by pressure regulating means 28.

Metering pump 32 provides liquid coating material from supply conduit 34 to feed conduit 36 at a predetermined rate to provide a reservoir 37 of the liquid coating material at the confluence of web 12 and smoothing film 20. Preferably, metering pump 32 is driven by, for instance, belt 38 connected to driven pulley 39 of metering pump 32 at one end, and drive pulley 40 of roller 18 at the other end of belt 38. Thus, the desired amount of liquid coating material is provided as a function of the speed of guide roller 18. However, under steady state operating conditions, a constant rate drive of metering pump 32 from an independent source (not shown) is of course workable.

Reservoir 37 of liquid coating material at the confluence of smoothing film 20 and web 18 provides a readily controllable coating on web 12 with, in essence, force generated by membrane 22 controlling the thickness of the coating and the rate of delivery by metering pump 32 controlling the width of the coating. The primary function of stationary smoothing film 20 is to provide an area of high shear force to the coating liquid, this in turn generating high hydrodynamic pressure, and to thus spread and smooth the liquid coating material to a uniform thickness along the web's length. As web 12 emerges from smoothing film 20, a coated substrate 44 is provided with liquid coating material evenly dispersed across the face of web 12 in a smooth and reproducible manner, and without a flow of surplus liquid coating material at the end of smoothing film 20.

Since the coating nip or zone comprises a moving member 12 and a stationary member 22, the coating fluid at the confluence of these two members is subjected to high shear force, and in turn high hydrodynamic pressure, for the entire time of the material's residence in nip 14, 22. This residence time is a function of the line speed of web 12 and the adjusted position of membrane 22 toward or away from roller 14. More specifically, for a given position of membrane 22, the residence time decreases as the line speed increases; and for a given line speed, the residence time decreases as membrane 22 is moved away from roller 14, and increases as member is moved toward roller 14.

FIG. 5 shows the effect of a change in coating thickness as a function of a change in residence time, with the line speed and the pressure within membrane 22 remaining constant. Since this graph is a generalized teaching, it is merely representative. However, it is apparent that once a critical residence time is reached, such as at about operating point 500, the coating thickness no longer changes significantly as residence time increases. An ideal operating point is at about 501. This residence time is substantially that of the critical residence time, and it yet allows some variation in residence time to occur with no appreciable change in coating thickness. An increase in the pressure within membrane 22 will not change residence time operating point 501. However, a change in this pressure will produce a change in coating thickness.

Figure 3:
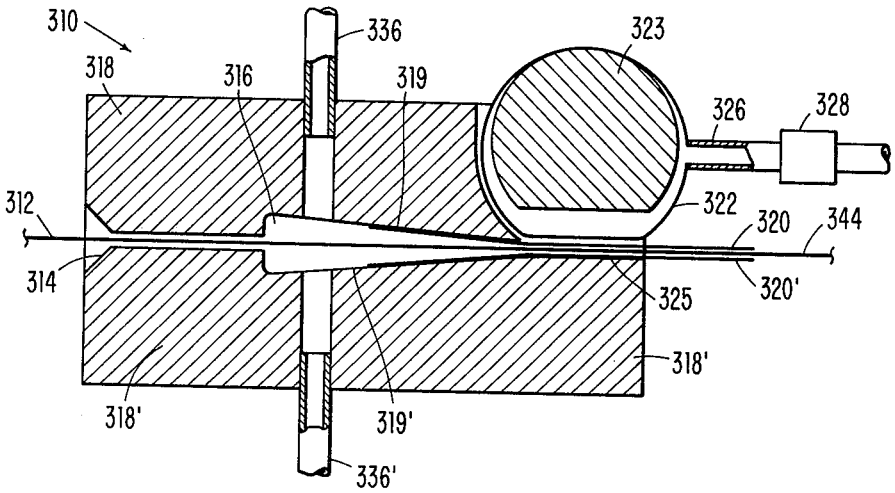
FIG. 3 is a simplified sectioned side view of the present invention for coating both sides of a moving web with the same or different coating liquids.
Figure 4:
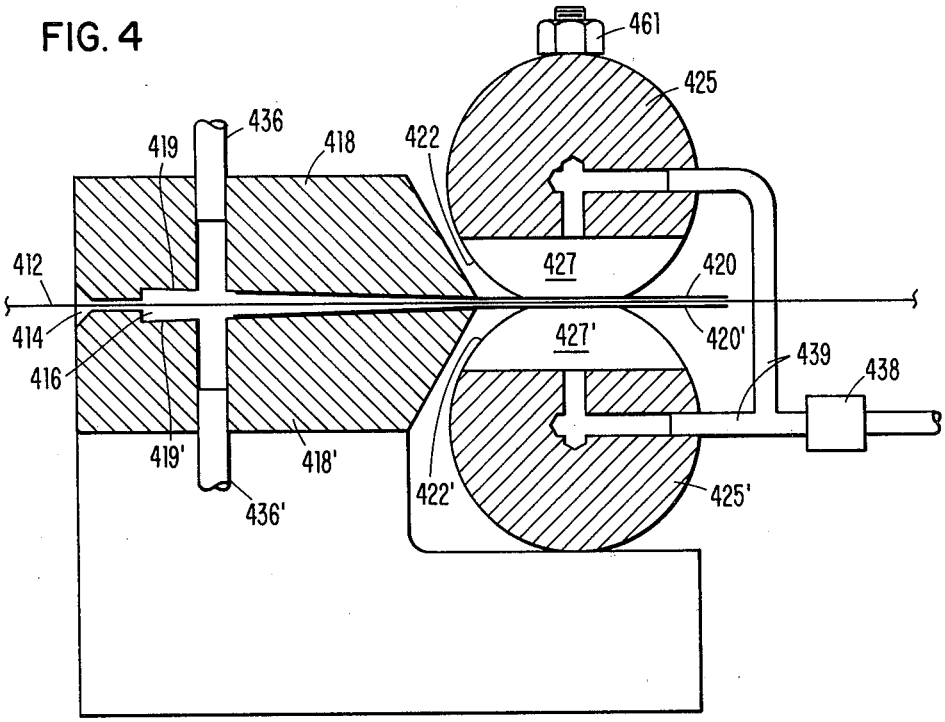
FIG. 4, which does not appear in said related applications, is a side view of a second embodiment of the present invention, not contained in said related applications.

The aforesaid critical residence time provided by the FIG. 1 embodiment is also provided by the embodiments of FIGS. 3 and 4 hereof.

Various changes and advantages of the above-described method and apparatus will be apparent to those skilled in the art. For instance, a number of outlet conduits 36 could be provided across the face of web 12 to provide a plurality of strip coatings on web 12 which would be convenient for later splitting into individual coated sections. The size of reservoir 37 is readily controlled by the rate of metering to avoid spreading of the liquid coating material to the edge of the web thereby facilitating high speed operation with desired margins free of excess coating material at the edge of back-up roller 14. Thixotropic liquid coating materials can readily be maintained in a flowable state by the shearing action of metering pump 32 and the shearing action of web 12 at reservoir 37, as previously described.

An embodiment of the coating apparatus according to the instant invention is illustrated in FIG. 3, and generally designated 310. As shown, coating apparatus 310 is in the form of a dual side coating device with web 312 entering inlet slot 314, which fits relatively closely adjacent web 312. Enlarged coating throat 316 is defined in die block 318 with converging downstream walls 319. For purposes of discussion, it will be noted that die block 318 is substantially symmetrical (except for the outlet end), and accordingly the upper portion and related features will be designated 318, while the lower portions will be designated 318'. Converging walls 319 and 319' of coating throat 316 communicate with upper conduit inlet 336 and lower conduit inlet 336'. In this manner, two independent streams of coating material may be metered to opposite sides of web 312. Upper smoothing film 320, and lower smoothing film 320' are attached to walls 319 and 319', respectively, and extend past membrane 322 carried on mandrel 323 and bearing against backing means 325 defined on die block 318'. Line 326, and pressure regulating means 328, communicate with the interior of membrane 322, thus accommodating variations in pressure within membrane 322.

From the above description of coating apparatus 310, it will be apparent that an upper coating may be formed on web 312 by liquid coating material metered at conduit inlet 336, and an independent lower coating may be formed by liquid coating material metered at conduit inlet 336', to produce a coated web 344 which may be coated on both sides with the same material, or with different materials on opposite sides. By providing different rates of metering of liquid coating materials to the upper and lower portions of web 312, coatings of different widths may be produced on opposite sides thereof. Also, by varying the rheological properties of the independent streams of liquid coating material, coatings of different thicknesses are obtained on opposite sides of web 312. A dynamic seal is accomplished at inlet slot 314 and the adjacent opening defined in die block 318 in that moving web 312 presents a resistance to flow of liquid coating material toward inlet slot 314, thus effectively countering the pressure difference between coating throat 316 and the atmosphere at inlet slot 314. This is accomplished without contacting web 312 with other than liquid coating material.

Figure 6:
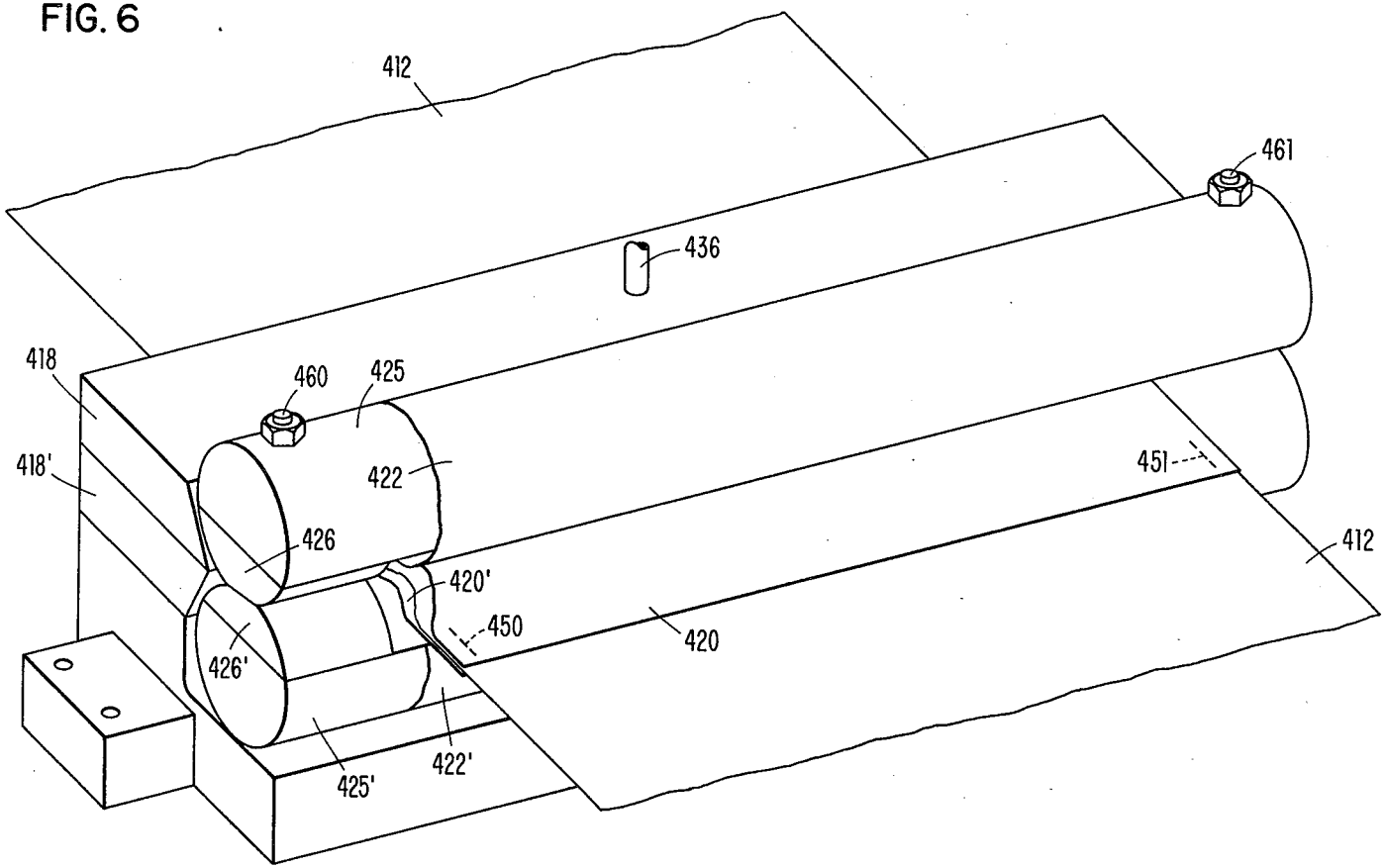
FIG. 6, which does not appear in said related applications, is an isometric view of the embodiment of FIG. 4.

The relative width relationship between backing means 325 and smoothing films 320, 320', web 344 and membrane 322 is as shown in FIG. 6.

A second embodiment of the present invention is seen in FIGS. 4 and 6. This dual side coating device includes a similar entering inlet slot 414 which fits relatively closely adjacent web 412. Enlarged coating throat 416 is defined in die block 418, 418', and includes converging downstream walls 419, 419'. These converging walls communicate with upper conduit inlet 436 and lower conduit inlet 436'. In this manner, two independent streams of coating material may be metered to opposite sides of web 412, in accordance with the coating width desired on each respective side of the web.

The left-hand extremity of upper smoothing film 420 and lower smoothing film 420' are attached to walls 419 and 419', respectively, and extend past a first upper membrane 422 and a lower second membrane 422'.

Each of these membranes comprises a pliant pressure generating means in the form of a tubular membrane formed of thin flexible material. Each such membrane encircles a metal support 425, 425', also of generally circular cylinder shape. The circular cylinder shape of these metal support members is completed, at the end portions only, by resilient but solid rubber sectors 426, 426', two of which are shown in FIG. 6. As a result of this construction and arrangement, each of the pliant pressure generating means is provided with a void 427, 427' which is pressurized at a selected pressure by virtue of pressure regulator 438 and conduits 439 (not shown in FIG. 6).

By virtue of the construction and arrangement of FIGS. 4 and 6, the top surface of web 412 may be coated at a first width and with a first material, as the bottom surface of the web is coated at the same or a different width with the same or a different material. Here again, the intended operative coating zone is of a width approximately 450 to 451 (FIG. 6), and of a length (FIG. 4) represented by the flat, coplanar portion of membrane 422, smoothing film 420, web 412, smoothing film 420' and membrane 422'.

As is apparent from the above description, each of respective membranes 422, 422' comprises the backing surface for the other membrane. The thickness of the web's upper and lower coating is controlled by the pressure to which voids 427, 427' are pressurized. The length of the coating zone, and thus the residence time of the coating materials within the coating zone's influence of static force and hydrodynamic pressure, is determined by the adjustment of mounting bolts 460 and 461 which penetrate but freely pass through the opposing end-disposed rubber sectors. That is, as these bolts are tightened, the four opposing rubber sectors flatten, the length of the coating zone increases, and the residence time increases, assuming a constant line speed for web 412.

It is preferable that the axis of membranes 422, 422' remain parallel to each other, perpendicular to the direction of travel of web 412, and parallel to the plane of the coating zone. In addition, bolts 460, 461 should be adjusted such that the length of the coating zone is uniform between the two bolts.

From the above description, it will be apparent that the coating apparatus according to the instant invention, in its various embodiments, provides for a unique coating mechanism wherein liquid coating material is metered at the rate of consumption by the coating operation to a zone at or adjacent to the area at which the smoothing film is urged toward a backing means by the pressure generating means. Thus, the width of the coating is determined by the rate of metering, and the thickness of the coating is determined by the static force applied to the smoothing film. Very uniform thicknesses, on the order of between plus or minus 5 microinches to plus or minus 10 microinches have been obtained with a thin flexible membrane providing the static force. The hydrodynamic pressure in the coating fluid, caused by the membrane's static force zone, provides for very smooth coatings and the enclosed, immediately utilized feed supply of liquid coating material avoids problems attributable to drying and contamination of the coating material. Thin coatings, i.e., less than 100 microinches, have been obtained with high line speeds on the order of 450 feet per minute. Despite providing for smooth, thin coatings, the compliance of the smoothing film and the pressure generating means permits passage of web splices and particles of coating material. A particle trapped and held by the smoothing means would of course cause a continuing defect. Different fluids may be coated on different sides and different thicknesses and/or widths may be obtained on opposite sides of the web. The smoothing film is readily replaced and constitutes the only component of the coating apparatus which contacts the liquid coating material, and the only component which bears closely upon the web in the coating zone. Rather than relying upon a precisely machined part subject to wear, a carefully controlled high static force and hydrodynamic pressure acting on the coating fluid for at least a critical time period produces hydrodynamic pressures in the coating fluid that conveniently and economically control the coating. However, more fundamentally, the instant invention provides a method entirely avoiding the prior art concept of applying excess coating material to the entire surface of a web, and then scraping or squeegeeing the excess from the web for recycling, or to be wasted.

The objectives of the aforesaid embodiments are generally to produce a desired and controlled coating thickness, of a desired and controlled width (i.e. of a width measured normal to the direction of web travel), and of continuously uniform thickness measured both normal to the direction of web travel and along the length of the web. Assume the web's line speed to be a desired constant. The coating's thickness is controlled by the magnitude of the static force with which the smoothing flap is urged or loaded against the web. The width of the coating is controlled by the rate at which coating fluid is metered to the confluence of the web and the smoothing flap upstream of the coating zone. Uniform coating thickness transverse to the direction of web movement is achieved by the accuracy of mounting the membrane and by the compliant nature of the membrane along the dimension of the backing support means transverse to web movement. Uniform coating thickness along the length of the web is achieved by the high-shear-force, high hydrodynamic pressure, coating zone whose coating residence time is at least the critical residence time from which slight time variation does not create appreciable variation in coating thickness.

In all embodiments of the present invention, the moving web is guided through the coating zone in a fixed-position plane. The smoothing film and the pressure generating means both occupy parallel planes. This parallel relationship insures that whatever coating thickness is desired, the coating will be uniform transverse to the direction of web movement. Due to the membrane, this parallel relationship is somewhat self-adjusting due to the pliant nature of the tubular shaped membrane.

Though but a limited number of preferred embodiments of the present invention have been illustrated and described, it is anticipated that various changes and modifications will be apparent to those skilled in the art, and that such changes may be made without departing from the scope of the invention as defined by the following claims.

What is claimed is:

1. Apparatus for coating a moving web with a coating liquid, the apparatus comprising:

a pair of stationary smoothing films mounted one on each side of the moving web;

a backing surface adapted to engage at least a portion of one of said smoothing films opposite the moving web so as to guide the web in a fixed-position path of travel;

a pair of metering means to meter a coating liquid to both sides of the web through at least one orifice which is positioned adjacent the confluence of the smoothing films and the web, whereby the web may be coated on both sides with the properties of the coatings being independently controlled; and first pliant pressure generating means positioned to bear against at least a portion of the other of said smoothing films in a manner to position said other film adjacent the web and to provide both a static force and a high-hydrodynamic-pressure coating zone between the web and both of said films, compliance of said pressure generating means to said backing surface providing a coating zone whose length, in the direction of web movement, applies said hydrodynamic pressure to the liquid for at least a critical time interval which is sufficient to insure uniform coating thickness to the length of the web.

2. Apparatus for coating a moving web as set forth in claim 1 wherein said backing surface comprises a second pliant pressure generating means.

3. Apparatus for coating a moving web as set forth in claim 1, which further comprises an enclosure having defined therethrough a channel divided into an inlet slot adapted to receive and fit closely to the moving web, a throat section of enlarged cross-section communicating with the inlet slot and having walls converging in the direction of travel of the moving web, the metering means communicating with the throat section independently on each side of the web, with the pair of smoothing films being attached to the converging walls on either side of the web, the backing surface being positioned adjacent the terminus of one converging wall of the throat section and adjacent said one smoothing film, and the first pressure generating means being positioned opposite the backing surface and adjacent the terminus of the other converging wall of the throat section with said other smoothing film positioned adjacent thereto.

4. The apparatus for coating a moving web as set forth in claim 2 wherein said backing surface comprises a second pressure generating means.

5. Apparatus for coating a moving web, the coating apparatus comprising:

an enclosure having an opening defined therethrough corresponding substantially to the width of the web, and, at the inlet portion of the opening, including sealing means to provide a fluid seal around the web, and having an enlarged cross-sectional throat section at intermediate portions with the walls thereof converging in the direction of travel of the web;

backing support means adjacent one of the converging walls substantially at the terminus thereof;

first pressure generating means positioned opposite the backing support means and adapted to bear towards the backing support means;

a pair of smoothing films positioned one at the backing support means and one at the pressure generating means and adapted to bear upon opposite sides of the web; and means to meter coating liquid into the enlarged volume defined at the throat section, the metering means communicating with the throat section at opposite sides thereof;

whereby coating liquids metered into the throat section will be prevented from escaping from the enclosure at the inlet portion thereof by the sealing means around the web, and wherein coatings may be formed on opposite sides of the web by the metering means and the smoothing action of the smoothing films interposed between the pressure generating means and the backing support means.

6. Apparatus for coating a moving web as set forth in claim 1 wherein said backing support means is a second pressure generating means.

7. Apparatus for coating a moving web as set forth in claim 1 in which independent metering means provide coating liquid to opposite sides of the web, whereby differing coatings may be provided on opposite sides of the web.

8. Apparatus for coating a moving web as set forth in claim 1 in which independent metering means provide coating liquid to opposite sides of the web, whereby differing coatings may be provided on opposite sides of the web.

9. Apparatus for coating a moving web as set forth in claim 1 in which the first pressure generating means comprise a closed, pliable membrane and a source of fluid under pressure communicating with the interior of the membrane.

10. Apparatus for coating a moving web as set forth in claim 1 in which said backing support means is a second pressure generating means having a closed, pliable membrane and a source of fluid under pressure communicating with the interior of the membrane.

11. Apparatus for coating a moving web as set forth in claim 1 in which the metering means includes at least one metering pump operatively connected to the moving web to meter coating liquid as a function of the velocity of the moving web.

12. Apparatus for coating a moving web as set forth in claim 1 in which the backing support means comprise a planar surface opposite the first pressure generating means.

13. Apparatus for coating a moving web as set forth in claim 1 in which the backing support means is a second pressure generating means opposite the first pressure generating means.

14. Apparatus for coating a moving web as set forth in claim 1 in which the sealing means comprise an inlet opening channel closely adjacent to but spaced from the web, whereby the drag of the moving web upon the coating liquid serves to seal the inlet portion of the web opening through the enclosure.

15. A method for coating a moving web with a coating liquid comprising:

conducting one side of a web over a first smoothing film which is supported by a backing support means;

urging a second smoothing film toward the opposite side of the web by means of pliant pressure generating means;

metering a coating liquid at a predetermined rate onto both sides of the web adjacent the confluence of each smoothing film and the web; and varying the pressure of the pressure generating means to vary the force with which the smoothing films are urged against the web.

16. A method for coating a moving web as set forth in claim 1 in which differing coating liquid is metered onto each side of the web.

17. A method for coating a moving web as set forth in claim 1 including the step of metering different liquids to each side of the web to thereby form coatings of differing thicknesses on each side of the web.

18. A method for coating a moving web as set forth in claim 1 including the step of metering liquids at differing rates on each side of the web to thereby coat the web to different widths on opposite sides of the web.

19. A method for coating a moving web as set forth in claim 1 including the step of providing a second pliant pressure generating means as said backing support means.

20. Apparatus for coating both sides of a moving web with a coating liquid, the apparatus comprising:

a pair of pliant pressure generating means disposed on opposite sides of the web, each pressure generating means including an inflatable, tubular membrane which is closed at each of its opposite ends by a resilient member, the resilient members of one membrane being directly opposite the resilient members of the other membrane;

a pair of stationary smoothing films mounted one on each side of the web and having free ends extending in the direction of web movement, between a side of the web and the adjacent membrane;

adjustment means operable to bring the membrane's resilient members into physical engagement and to deform the resilient members so as to establish a coating zone whose length is controllable, as measured in the direction of web movement; and a pair of metering means to meter coating liquid to both sides of the web at a position upstream of the coating zone and to the confluence of the web and the smoothing films.

* * * * *

UNITED STATES PATENT AND TRADEMARK OFFICE

CERTIFICATE OF CORRECTION

PATENT NO. : 4,327,130

DATED : April 27, 1982

INVENTOR(S) : David J. Pipkin

It is certified that error appears in the above—identified patent and that said Letters Patent is hereby corrected as shown below:

Claim 6, line 31, delete "1" and insert --5--.

Claim 7, line 34, delete "1" and insert --5--.

Claim 8, line 39, delete "1" and insert --6--.

Claim 9, line 44, delete "1" and insert --5--.

Claim 10, line 49, delete "1" and insert --9--.

Claim 11, line 54, delete "1" and insert --5--.

Claim 12, line 59, delete "1" and insert --5--.

Claim 13, line 63, delete "1" and insert --5--.

Claim 14, line 67, delete "1" and insert --5--.

Claim 16, line 21, delete "1" and insert --15--.

Claim 17, line 24, delete "1" and insert --16--.

Claim 18, line 29, delete "1" and insert --17--.

Claim 19, line 4, delete "1" and insert --18--.

Signed and Sealed this

*Tenth* Day of *August 1982*

[SEAL]

*Attest:*

GERALD J. MOSSINGHOFF

*Attesting Officer*

*Commissioner of Patents and Trademarks*